US005896092A

United States Patent [19]

Bechtel

[11] Patent Number: 5,896,092

[45] Date of Patent: Apr. 20, 1999

[54] ALARM SYSTEM

[75] Inventor: Jon H. Bechtel, Holland, Mich.

[73] Assignee: Gentex Corporation, Zeeland, Mich.

[21] Appl. No.: 08/829,320

[22] Filed: Mar. 27, 1997

[51] Int. Cl.[6] ..... G08B 5/36

[52] U.S. Cl. ..... 340/815.73; 340/321; 340/332; 340/693.5; 340/815.75

[58] Field of Search ..... 340/321, 332, 340/573, 574, 693.5, 815.73–815.75; 362/328, 329, 332

[56] References Cited

U.S. PATENT DOCUMENTS 3,849,769 11/1974 Chiba ..... 340/815.75
4,559,589 12/1985 Sassmannshausen ..... 362/329
4,912,606 3/1990 Yamamoto ..... 362/328
5,160,192 11/1992 Sugawara ..... 362/328
5,582,480 12/1996 Zwick et al. ..... 362/329
5,641,218 6/1997 Sakurai ..... 362/328

*Primary Examiner*—Daniel J. Wu
*Attorney, Agent, or Firm*—Malcolm R. McKinnon

[57] ABSTRACT

An improved alarm system particularly adapted for use in attracting the attention of hearing impaired persons and/or for use in attracting the attention of persons in high decibel areas, it being understood that the system is applicable to other uses. The system incorporates an improved light reflector and improved Fresnel lenses which cooperate with a flash tube whereby the system projects as much of the available light as possible into a predetermined profile so that UL requirements are met with a minimum of wasted light.

14 Claims, 8 Drawing Sheets

ALARM SYSTEM

BRIEF SUMMARY OF THE INVENTION

This invention relates to alarm systems and, more specifically, to an improved alarm system particularly adapted for use in attracting the attention of hearing impaired persons and/or for use in attracting the attention of persons in high decibel areas, it being understood that the present invention is also applicable to other uses.

Heretofore, various alarm systems have been utilized in areas of commercial and residential buildings as well as in outside areas for the purpose of attracting the attention of persons in such areas, as for example, to warn of the danger of a fire or to alert such persons to a telephone call or for myriad other purposes. Many prior alarm systems emit an audible alarm, but an audible alarm may not provide an adequate warning for hearing impaired persons or for persons in high decibel areas, so that it is possible that an audible alarm may not be heard under noisy environmental conditions even by persons having unimpaired hearing. Heretofore, strobe flashes have been used in smoke and fire alarm systems of the indicated character to alert persons of an alarm condition. The systems which incorporate these strobe warning devices typically include multiple warning devices which are wired in parallel to a common alarm source. Each alarm source has a maximum alarm load electrical current specification which must not be exceeded by the sum of the load currents of the individual alarm devices connected in parallel to the source. Thus, a reduction in the electrical current consumption of the strobe flash will usually result in a corresponding increase in the number of alarm units which can be attached to a particular alarm source and its associated wiring run. Furthermore, safety requirements normally require battery backup systems which are capable of maintaining the alarm condition for a specified minimum time period in the event of a primary power source failure. Reduction of the strobe electrical current consumption results in a proportionate reduction in the battery capacity needed to sustain the flashing strobe alarm for the required time period.

Many strobe alarm devices are mounted on vertical walls six feet or more from the floor so that little or no light must to be directed above the horizontal plane in which the strobe is mounted and so that the greatest light intensities are needed in the horizontal plane and in directions slightly downward toward the floor. A weaker light output is required in directions directed more sharply downward toward the floor since persons positioned to view light from these directions must be relatively close to the strobe in order to see the light before it strikes the floor.

An object of the present invention is to overcome disadvantages in prior alarm systems of the indicated character and to provide an improved alarm system incorporating a reflector and lens system which projects as much of the available light as possible into a required profile so that the Underwriters Laboratory (UL) requirements are met with a minimum of wasted light. The UL specifications presently require minimum intensities in only the horizontal and the vertical planes for wall mounted units and in two vertical planes which are perpendicular for ceiling mounted devices. Some prior art designs have met the requirement in these specified planes at the expense of reasonable light output in the overall pattern to be covered by the strobe, and another object of the present invention is to reasonably fill the overall pattern and not just the profiles required by UL.

Since an error of $\Delta\Theta$ in the angle of a portion of a reflecting surface causes an error of two times $\Delta\Theta$ in the direction of the reflected light, the requirements for precision in the tools to produce the reflectors are rigorous. In comparison, an error of $\Delta\Theta$ in the angle of the surface of a refracting lens will cause a deviation of approximately one half $\Delta\Theta$ in the angle of the refracted light. One of the more precise machining processes short of single point diamond machining is wire EDM. In this process arcing from a stretched wire which is continually renewed by reeling in fresh wire is used to cut a precise path through a metal plate. This process is generally useful only in producing cylinderical surfaces. For this reason, it is another object of the present invention to provide an improved alarm system incorporating a strobe light reflector in which substantially all of the reflective surfaces are cylindrical.

It is a common practice in the prior art, even for cylindrical reflectors, to design the reflectors using profiles which are simple geometric shapes or a composite of a relatively few such reflecting surfaces. For example, flat reflecting surfaces, and cylinders with a parabolic or a circular cross section have commonly been used, and another object of this invention is to provide more general curves for the cross sections of the cylindrical reflectors incorporated in the alarm system, and to characterize these curves so as to direct light into a specific profile.

It is another object of the present invention to provide an improved alarm system incorporating a single cylindrical reflector which is substantially longer than the light emitting portion of the strobe light tube in combination with a transparent cover which has sections of approximately spherical Fresnel lenses molded in the transparent cover and positioned close to the intersection of the cover with the longitudinal axis of the strobe light, whereby at least some of the Fresnel lens sections are used to focus light into beams to cover specific areas in the required light output pattern which are on or close to the axis of the strobe light tube. In a preferred embodiment of the invention, the lens portions are preferably molded in the outside of the transparent cover and positioned particularly to complete the required pattern close to the axial direction at each end of the tube. The Fresnel sections may be non-spherical, conical or aspheric for example; but should preferably be portions of a surface of revolution so that highly accurate mold surfaces can be generated using, for example, a lathe turning operation. The beams projected by the Fresnel lens sections tend to be bright and narrow covering as little as three degrees between half intensity points. With many cover configurations the Fresnel lens sections require slides in the mold. It is advantageous to design the lens sections as surfaces of revolution so that mold inserts of the required precision can be fabricated on a lathe at reasonable cost.

It is another object of the present invention to place the lens portions on areas of the transparent cover where they do not interfere significantly with light reflected into the important horizontal profile. More generally, portions of the cover used to transmit required reflected or directly radiated light which is already directed in the correct direction are left transparent and free of lenses. The lensed area is preferably chosen so that where it does interfere with light from the reflector, there are other portions of the reflector which reflect light through clear unlensed portions of the transparent cover into the same general area where the lens creates interference. In the preferred reflector, an area which reflects light generally into the range between the horizontal plane and a direction downward 30 degrees toward the floor receives overlapping coverage from two portions of the reflector. The lensed area is confined primarily to the area through which light from one of these sections is directed and the other is left substantially clear and unlensed.

It is an optional objective to incorporate cylindrical lens sections on the opposing face of the lens cover relative to the Fresnel lens sections and optically aligned with one or more of the Fresnel lens sections to fan the bright spots of light into elongated patches which may, for example, cover five degrees in light emitting angle for each of the Fresnel sections which are so arranged. By properly arranging the sections where light is directed through both the approximately spherical and the approximately cylindrical lens sections, the required profile can be shaped into a smoothly varying curve which is closely matched to the required intensity. The cylindrical lens portions are preferably incorporated without creating the need for additional slides in the mold used to produce them and with a nominal increase in the plastic thickness (0.017 inches for example) for each lens section. The radius of the cylindrical surface is chosen so that the variation in surface angle over the face of the lens causes the desired corresponding variation in the angle through which the light is refracted. The focused beam of light is fanned out by an amount which is approximately equal to the total variation in the refracted angle. It is an objective to treat the strobe light tube when viewed generally from the end as an approximate point source for the purpose of designing the approximately spherical lens sections to focus light generally in the direction of the axis of the tube. Thus, the focal length of the lens segments is normally chosen to focus approximately on the center of the tube. Each Fresnel lens section is generated generally as a surface of revolution about a center point. Thus, each focuses the light from the tube in the same general direction as a pin hole approximation of the lens placed at its center of revolution. It is an object of the present invention to incorporate a number (for example three in the transparent cover at each end of the strobe light tube) of Fresnel lens portions each generated from the same or similar surfaces of revolution and each with its center aligned to project the bright image of the center of the tube into one of several required directions. None of the lens patches need to include their centers of revolution. Also, the design guide given is an approximation and adjustments may be made through calculation or experimentation to correct for errors in the approximation. Several observations are as follows: The center of the lens patch, that is the center of revolution from which the surface of the lens patch was generated, is in the deep shadowed portion of the lens surface for many of the lens patches so it is the off angle light entering through the larger lens aperture which is directed into the beam. Thus, the lens serves to bend light into a relatively bright, concentrated beam which is directed in what otherwise would be a relatively dark area in the field of the flash. Note that the pinhole approximation used above to choose the approximate location of the optical center for the lens patch is good only for this purpose. Not only does a pin hole not collect much light because of its small aperture, for many of the lens patches in the application, very little light is radiated in the direction of the optical lens center, i.e. the center of rotation of the surface generator for the lens patch. The lens does have limits in its ability to direct light into dark areas. Since it is not practical to refract the light through angles of much more than 30 degrees, the fact that the light intensity remains stronger than predicted by the cosine law until it is about 13 degrees from the axis of the tube is important to the success of this approach. If the cosine law had been assumed as others have done, this approach of relying on a lens to fill in the dark area may well have been deemed unfeasible as it has been by others since if the light distribution did follow the cosine law distribution, much of the collected light would have to be refracted through unrealistically large angles to fill the dark area and the dark area itself would be larger.

It is another object of the present invention to provide smaller diameter annular portions of each Fresnel lens section to focus at a point or points between the center and the near end of the light emitting section of the flash tube. The normal positions of the smaller diameter annular lens portions in the transparent cover are such that the light entering them comes from directions very close to the axial direction of the tube where much of the light is shadowed by the electrode and trigger wires. The shortened focal length focuses rays emitted at a correspondingly increased angle to the tube axis, and there is more light emitted at these increased angles and correspondingly more light effectively focused from this portion of the lens into the projected beam.

Another object of the invention is to provide a lens wherein the larger diameter annular portions of each Fresnel lens focus between the center and the far end of the tube. These sections of the lens must bend the light rays by a relatively large angle (28 degrees for example) requiring highly angled surfaces (42 degrees for example) in this section of the lens. The increased focal length requires reduced bending of the rays and correspondingly reduced angles of the lens surfaces. The effect of the reduced angles of the lens surfaces is to increase their efficiency and to increase the largest diameter of the annular lens facet which can be included in the lens.

In an optional embodiment, a more complex precision machining process is used to generate the mold for an approximately spherical lens, that is one in which a surface of revolution can be combined with an approximately cylindrical lens section to "fan" the projected beams to cover desired ranges in the required light output profile. In such a lens, the breaks in the Fresnel surface are no longer concentric circles and the surfaces between the breaks are no longer surfaces of revolution. With the more complex mold shape, it is desirable and possible to incorporate a single Fresnel lens section which focuses generally on the center of the tube and projects a single beam which is fanned through the required total sweep by the cylindrical component of the complex lens shape which is a composite of a generally cylindrical lens shape and of a lens shape which is generally a surface of revolution. One such lens is preferably positioned in the transparent cover at each end of the tube to fill in the required horizontal light output profile at the respective end of the tube. The shorter focal length for areas of the lens close to its optical center and of longer focal lengths for rays farther from the optical center of the lens are desirable options for this and for the objective which follows.

In another very desirable optional embodiment, a fanned output "beam" is created by progressively moving the center for some or all of the annular lens faces along a line in the direction that the beam is to be fanned or spread. The distance by which each successive center point is moved is chosen to characterize the intensity in the fanned beam. A smaller successive step concentrates the beam in the portions filled by the corresponding approximately annular sections and a larger step spreads the beam in the portions filled by the corresponding approximately annular sections. With this technique, the lens facets are approximately and not truly annular but they remain portions of true surfaces of revolution so that a mold for them may be fabricated on a lathe by changing the center of rotation as required between cuts for the various facets. This is a desirable approach because the beam is fanned in a controlled way without necessarily resorting to multiple Fresnel lens sections, without necessarily giving up the precision of the lathe fabrication of the mold, and without necessarily including the cylindrical shape on the opposing lens face.

It is a further objective in a wall mounted version to place a break in the slope of the cylindrical reflector at a level which is just above the top side of the flash tube (0 to 0.1 inch for example) and to use the portion of the reflector which is below the discontinuity and generally back of the flash tube to reflect light generally downward at angles of declination which are great enough to prevent substantially all of the reflected light from striking the flash tube. It is a further object of the present invention to create a generally parabolic shaped section on the reflector and adjoining the break in slope on its upper side and to direct this light into the horizontal plane. All surfaces of the reflector are preferably configured so that little or no light is reflected back through the flash tube. The reflector is designed so that the horizontal profile is reflected as described because this portion of the reflector meets both of the following requirements: First, it is the portion of the reflector which is closest to the tube which still meets the following second requirement. Second, it is a portion of the reflector (unlike that portion just below the break) for which light reflected into the horizontal plane will not strike the tube. The reason for this objective is based on the observation that the angle of a reflected light ray relative to the axial direction of the cylindrical reflector is equal to the angle of an incident light ray relative to this axial direction of the cylindrical reflector. Thus, a portion of the reflector which is closer to the tube will capture rays emanating from the flash tube at smaller angles relative to the axis and reflect them at correspondingly smaller angles. This has the effect of widening the distribution of the reflected light in the horizontal plane and leaving smaller portions of the required profile to be filled by other means.

It is another object of the present invention to incorporate in an alarm system a cylindrical reflector which is parallel to a linear flash tube and which extends to cover substantially the full area back of the light emitting portion of the tube. The cylindrical reflector is preferably substantially as long or longer than the light emitting portion of the tube and positioned parallel to and directly in back of the light emitting portion of the tube. The reflector extends far enough or at least nearly far enough to extend between planes which are perpendicular to the axis of the tube and which intersect the tube at each end of its light emitting section. The reason for this requirement is that the reflector has to be at least this long to direct all of the available light emanating in directions perpendicular to the axis of the tube into a profile which is perpendicular to the tube.

It is another object of the present invention to use a combination of approximately cylindrical and approximately spherical lens elements in the transparent cover to direct additional light in directions close to the axis of the flash tube to meet requirements for intensity in the horizontal plane.

The above as well as other objects and advantages of the present invention will become apparent from the following description, the appended claims and the accompanying drawings.

BRIEF DESCRIPTION OF THE DRAWINGS

FIG. 6 depicts comparison curves of various requirements and specifications.

DETAILED DESCRIPTION

Figure 1:
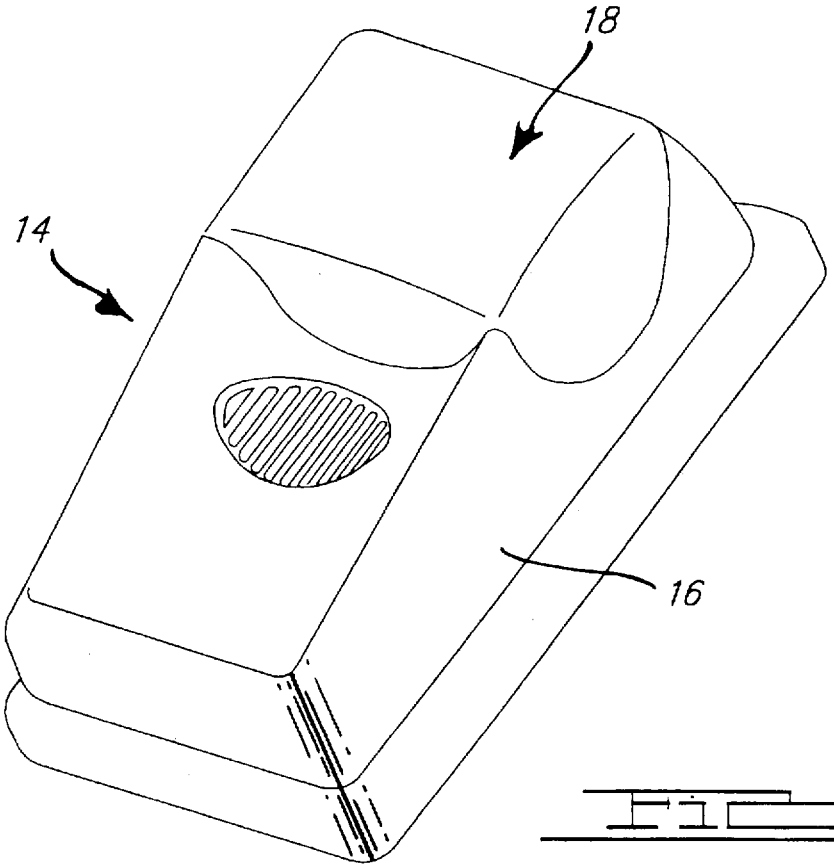
FIG. 1 is a perspective view of a signaling unit which may be incorporated in an alarm system embodying the present invention.
Figure 2:
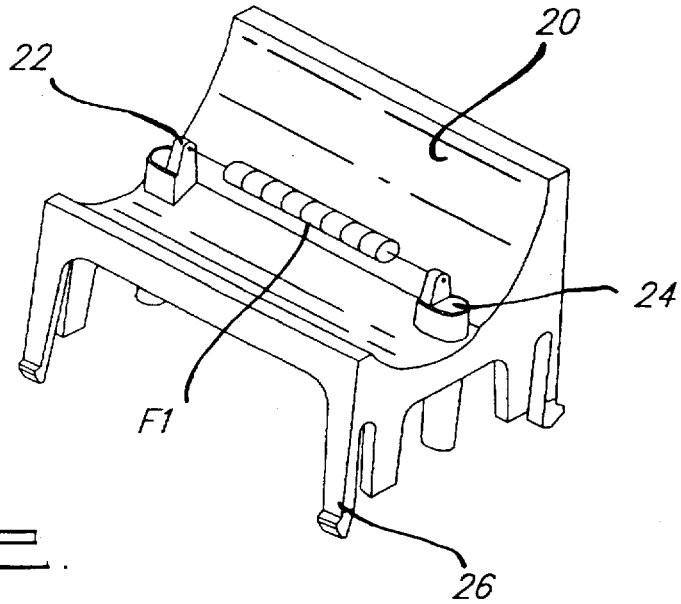
FIG. 2 is a perspective view of a flash tube and reflector combination embodying the present invention and incorporated in the signaling unit illustrated in FIG. 1.
Figure 3A:
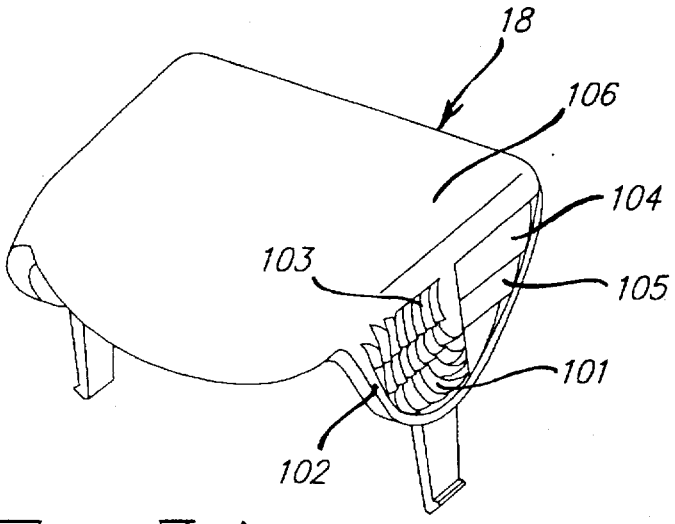
FIGS. 3A, 3B and 3C are perspective views of the cover of the unit illustrated in FIG. 1, the cover incorporating lenses embodying the present invention.
Figure 3B:
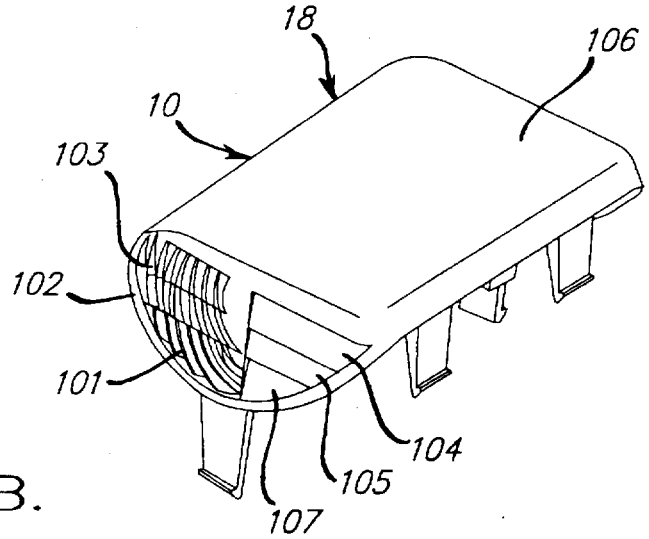
Figure 3C:
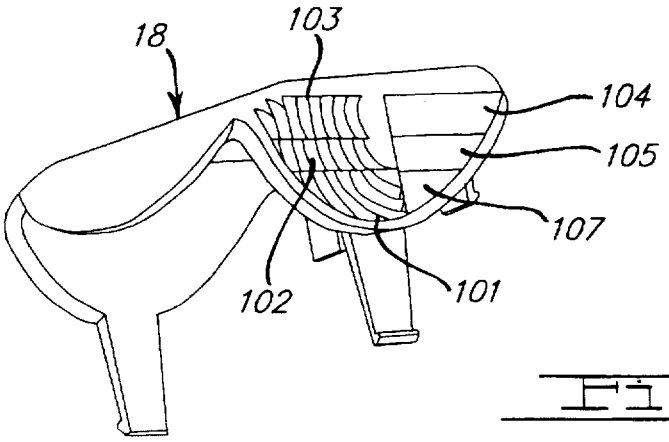

Referring to the drawings, an alarm system, generally designated 10, embodying the present invention is illustrated therein. The alarm system includes circuitry, generally designated 12, which will be described hereinafter in greater detail and which is adapted to be connected to a source of power. The alarm system 10 includes a signaling unit 14 comprised of a housing 16 which is adapted to housing circuitry 12. A signaling unit 14 further includes a lens, generally designated 18, adapted to selectively focus light emitted by a flash tube F1 incorporated in the circuitry 12. The components of the circuitry 12, which will be described hereinafter in greater detail, are preferably mounted on a circuit board (not shown) disposed within the housing 16. Preferably the flash tube is a Xenon flash tube having a gas tube filled with an ionizing gas, the flash tube being mounted in spaced relationship with respect to a reflector 20. The reflector 20 incorporates conventional mounting posts 22 and 24 for the flash tube F1. In the embodiment of the invention illustrated, the reflector 20 includes a plurality of locking tabs, such as 26, which function to secure the reflector to the circuit board in a conventional manner to provide a unitary structure.

Figure 4:
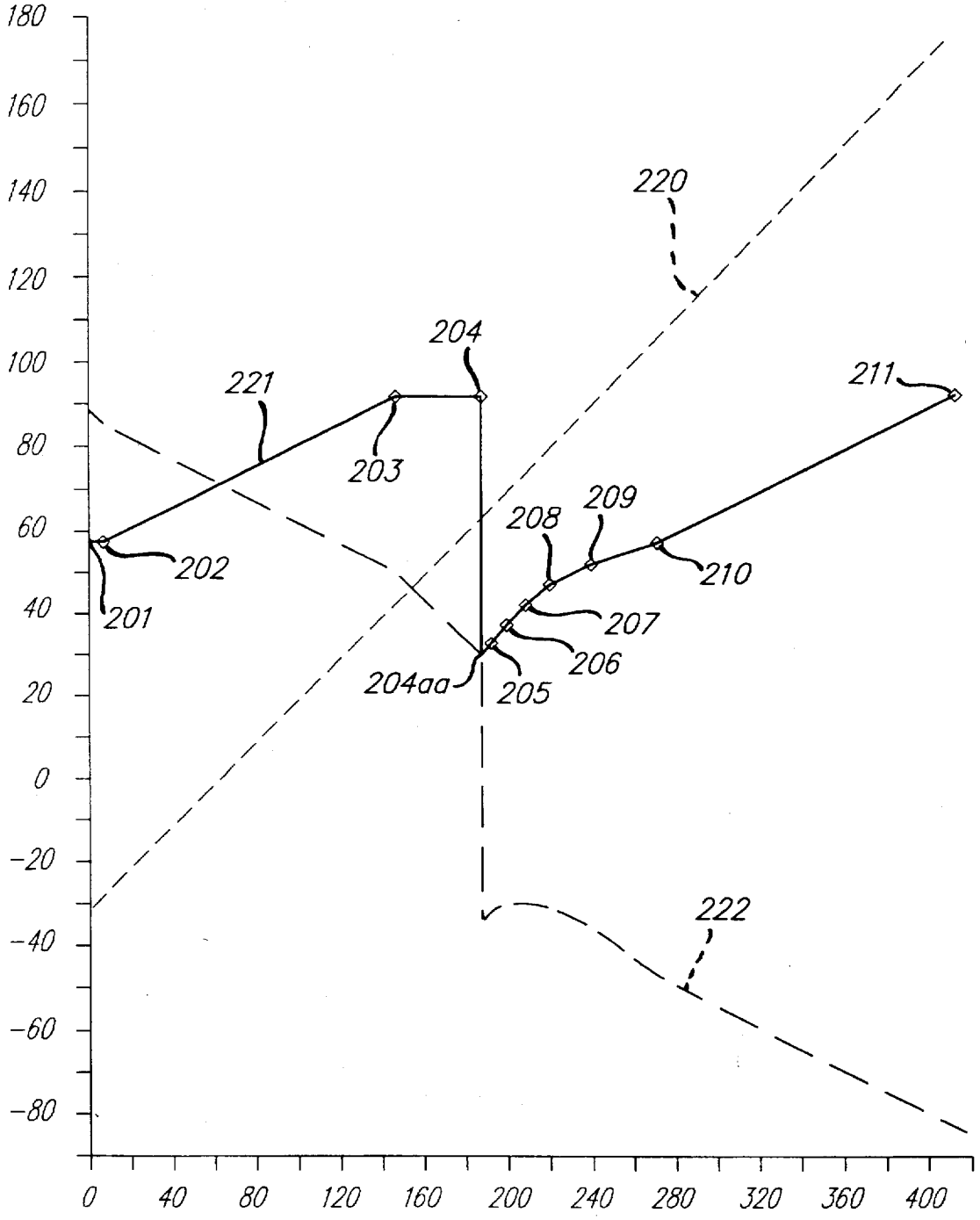
FIG. 4 is a graph depicting the reflection characteristics of the reflector illustrated in FIG. 2.
Figure 4A:
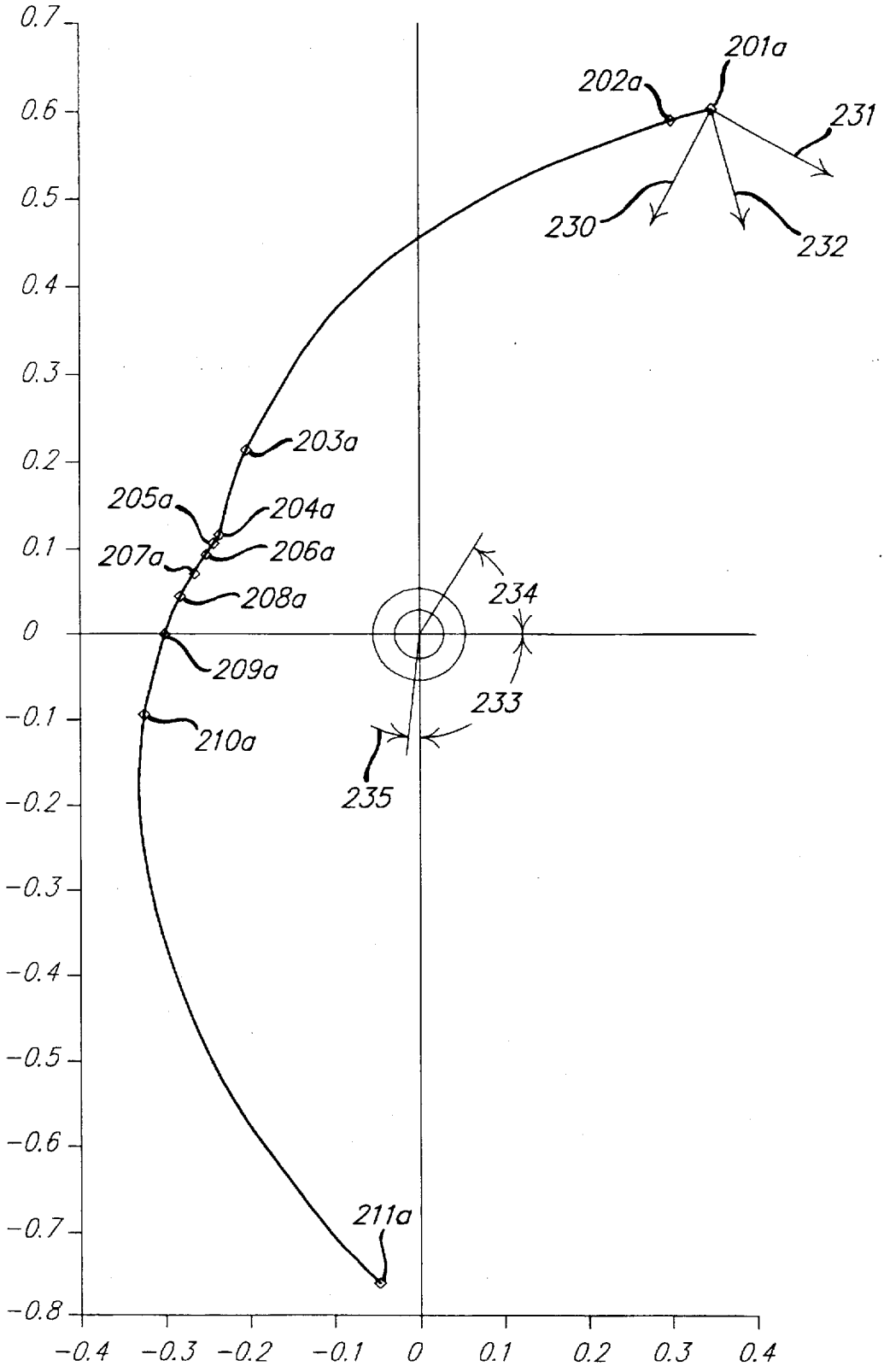
FIG. 4A depicts the preferred reflector profile of the reflector illustrated in FIG. 2.

Referring to FIGS. 1, 2, 4 and 4A, a preferred reflector profile for a wall mounted signaling unit 14 is shown in FIG. 4A. The reflector 20 was generated by first determining the relative proportion of light to direct into each part of the reflected light profile. The light output from the flash tube F1 was then divided into 0.5 degree sectors as viewed from the end of the tube. Since the light output from the tube F1 does not vary appreciably with radial direction, each of these 0.5 degree sectors receive substantially equal amounts of light from the tube. Then the total number of 0.5 sectors which intercept the reflector is multiplied by the proportion of light to allocate for each part of the reflected light profile to determine the number of sectors whose light should be directed into each of the portions of the profile. For convenience, these numbers are rounded to whole numbers of sectors. Referring to FIG. 4A, beginning at point 201*a*, a small mirror segment is made just wide enough to accept light from the 0.5 degree sector between −31 degrees and −30.5 degrees and is angled to reflect it in the desired direction. This is accomplished by choosing the angle of the mirror segment so that the normal to it bisects the angle between a first vector which points from the mirror segment to the flash tube F1 and a second vector which points from the mirror segment in the desired direction of the reflected ray. Refer to FIG. 4A where for the point 201*a* vector 230 points toward the flash tube; the vector 231 points in the desired direction of the reflected ray and the vector 232 bisects the angle between 230 and 231. The mirror segment is constructed so that it is perpendicular to the vector 232. Note that the width of the mirror surface required to just intercept the light from the 0.5 degree sector increases as the distance from the tube F1 increases and also as the magnitude of the acute angle of the mirror surface relative to the circumferential direction about the tube increases. To develop a manageable method to incrementally construct the mirror surface in a way that relative energy direct to each part of the profile is controlled, it is important to follow the method just described although it is possible to use some other workable method. A second mirror segment is then constructed with its first edge adjoining the second edge at −30.5 degrees where the first sector ended and it is in turn angled to direct its light in the desired direction. This process is repeated a total of 415 times to complete construction of the mirror surface. The curve of the profile of the faceted mirror is then optionally and preferably smoothed to form the finished mirror profile specification.

A computer program such as "Mathcad" from MathSoft Inc. 101 Main Street, Cambridge, Mass., 02142 USA is highly useful in performing this iterative process. The overall shape of the mirror cross-section is determined by the sequential assignment of the direction to which the light from each of the 0.5 degree sectors is reflected. Since the light input for each step in the iteration is constant, the light reflected from each mirror facet which just subtends a half degree sector is constant, being equal to the light input times the reflectance of the mirror. In the preferred reflector for horizontal mounting, there are 415 of these half degree sectors covering 207.5 degrees of the total 360 degree radiated pattern from the flash tube. The portion of the light coming from the tube in the 90 degree sector denoted by 233 in FIG. 4A is added to the reflected light and makes up part of the preferred profile. A small amount of light in the range 235 and a 59 degree sector in the range 234 are outside of the required profile. The section 234 is outside the profile because the point 201*a* extends substantially forward from the flash tube. The benefit of the increase in reflected light does not warrant further forward extension of 201*a* and the resulting increase in the reflector size and the increased protrusion of point 201*a*. It should be understood that in other designs this balance might fall at some other point. The overall reflector size can be linearly scaled without drastically altering the directional characteristics. In the preferred design, a nominal clearance of 0.24 inches is allowed between the center of the tube and the metallic reflector coating. If this space is made too small, there is danger that the high voltage strobe tube trigger pulse will short to the metallic reflector coating so that the strobe will not trigger properly. When brighter light output is needed in a portion of the profile, the equal light inputs from the successive steps may be directed into more closely spaced steps in the output direction and when less light is needed, the light input from successive steps may be directed into more distantly spaced steps in the output profile. For the preferred reflector, the relative reflected light output intensities were first determined for various directional ranges. Then the relative light requirement for each range was calculated by multiplying the relative intensity by the number of degrees in the range. These relative light requirements for each range were then totaled and each relative light requirement was divided by the total to give the fraction of the total reflected light to allocate to each range. The fraction of the total reflected light for each range was then multiplied by the total number of 0.5 degree steps to determine the number of half degree steps to allocate to each intensity range. The number of degrees in each range was then divided by the number of 0.5 degree steps allocated to that range and that increment was added to the angle to which the light was reflected for each successive step through the range. In this way, a range of angular directions in the output profile which required a constant intensity of reflected light was just covered by uniformly spaced steps of uniform light input. The steps are small enough that the diameter of the light emitting area in the flash tube substantially averages the steps or optionally that smoothing of the profile made up of the connected line segments results in an acceptably accurate curve.

The technique may be used with sectors of sizes other than 0.5 degrees as requirements for accuracy verses expedience in generating the curve changes. Note that when successive steps are directed to the same direction, a stepped approximation to a parabola is created. There are only two such sections in the reflector profile which is made up of nine complex sub-sections. The main one between points 203*a* and 204*a* on the reflector is directed generally into the horizontal plane. The other narrow parabolic section is from 201*a* to 202*a* and is added to peak the light output modestly before the abrupt fall off of the required level at angles beamed downward more than 30 degrees relative to the horizontal. This is for angles less than 60 degrees for the reference used in FIGS. 4 and 4A where the vertically downward direction is zero degrees and the horizontal direction extending from the wall is 90 degrees.

FIG. 4 depicts a set of curves used to specify the angle of the reflected light curve 221, the corresponding angle from which the light is received (that is the angle of the flash tube relative to the point on the reflector) curve 220 and the difference in the angle of the received and the reflected light curve 222. The number of the 0.5 degree step is indicated on the x axis and the angle for each of the three plots is indicated on the y axis. Curve 222 indicates how much the reflected light is angled away from the strobe tube. An angle of zero degrees would represent light reflected directly back through the tube. Since the diameter of the bore of the tube from which light is emitted is about 0.062 inch and the outside diameter of the tube is about 0.125 inch, the direction of the reflected light must differ from that of the incident light by approximately 20 degrees for the reflected light to clear the tube. The preferred embodiment of the invention has a discontinuity in the slope of the reflector positioned so that the angle of the reflected light makes a discrete step of about 64 degrees from 30 degrees above the tube center to 34 degrees below the tube center. Many prior art designs have reflected light back through the tube. This light, if not absorbed, is scattered and since much of the light is needed in a relatively narrow pattern, even the scattered light is most likely scattered to directions where it does not contribute to the required intensity pattern. On either side of the jump, the direction of the reflected light differs from that of the incident light by at least 28 degrees. As indicated in the objectives, the approximately parabolic section between 203 and 204 adjoins the discontinuity on one side and is thus on the part of the reflector which is the closest portion of the reflector to the tube for which reflection of light into the horizontal plane would not strike the tube. As explained, this close proximity to the tube reflects light which is incident and therefore is reflected at smaller angles relative to the longitudinal axis of the tube. This fills in more of the required horizontal profile in these directions.

FIG. 4 details the reflection characteristics, the transitions between different zones of the reflector being denoted by the numbers 201 through 211. The corresponding reflector profile is shown in FIG. 4A with the corresponding reflector sections delimited by 201*a* through 211*a*, respectively. The portion 201 to 202 generates a short parabolic portion centered on 58 degrees to generate a small peak before the reflected light level falls off for angles less than 60 degrees. The range between 202 and 203 generates a uniform relatively bright reflected light level for reflection angles varying from 58 to 92 degrees. The parabolic section between 203 and 204 is directed at 92 degrees to generate a pronounced peak generally at 90 degrees at the end of the high intensity range provided by the combined light from portions 202 to 203 and from 210 to 211. At 204 to 204*aa* is the stepped change in the slope of the reflector to avoid reflecting light back through the tube. The ranges between 204*aa* and 205, 205 and 206, 206 and 207, 207 and 208, 208 and 209, and 209 and 210 are characterized to reflect successively brighter uniform levels into the angular ranges from 29 to 33 degrees, 33 to 39 degrees, 39 to 43 degrees, 43 to 48 degrees, 48 to 53 degrees, and 53 to 58 degrees, respectively. The light reflected by the portion of the reflector from 210 to 211 reflects light into the range from 58 to 92.7 degrees which generally overlaps the range into which light from 202 to 203 is reflected.

Figure 4B:
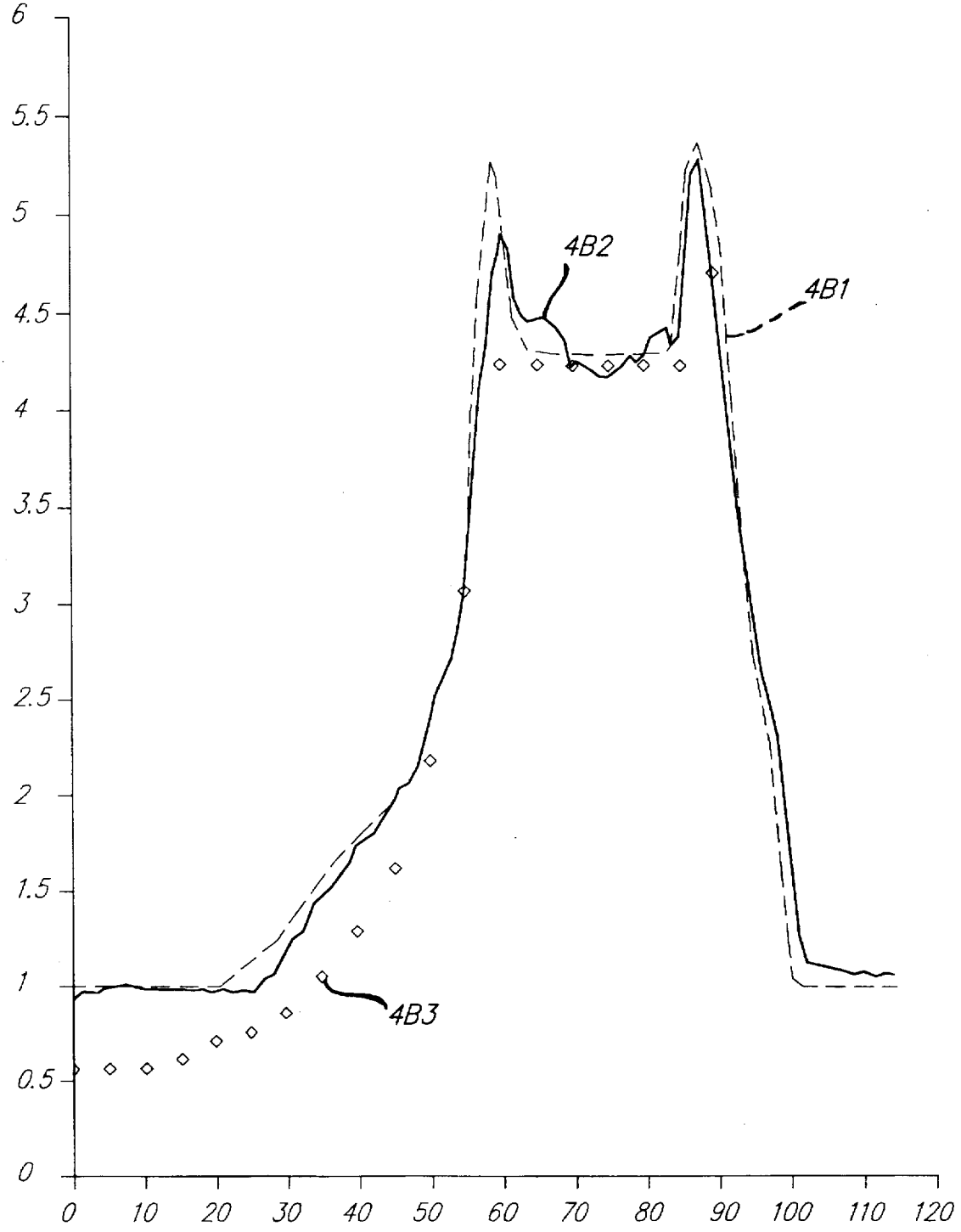
FIG. 4B is a plot of the output of the reflector of FIG. 4A in the vertical plane.

The curve 4B1 is a plot of the calculated output of the reflector of FIG. 4A in the vertical plane for which the diameter of the light emitting portion of the tube is taken into account. The x axis indicates direction in degrees with zero degrees toward the floor and 90 degrees directly out from the wall in the horizontal plane. The y axis is normalized to 1.0 for the light output of the tube with no reflector. A reflectance of 80 percent is assumed for the reflector. The diamond symbols are the relative intensities needed to meet the UL requirement in the vertical plane. The diameter of the flash tube prevents the parabolic sections from generating extremely sharp bright lines so FIG. 4B approximates the output due to these portions as rounded peaks of total area corresponding to the light striking the parabolic sections. The curve 4B2 is the measured result of a reflector made to the specification. The curve 4B3 is the UL specification for the vertical plane. Note the close correspondence of the three curves.

Referring to FIG. 6, several curves are shown for comparison. The curve 501 is for the UL requirement for the vertical distribution of a wall mounted strobe. Curve 502 is for the UL requirement for one half of the horizontal distribution for a wall mounted strobe and also that for the distribution in all four quadrants for a ceiling mounted strobe. The curve 503 is a cosine curve which has been assumed in the design of some prior art devices to be the light output distribution of a strobe tube in a plane containing the axis of the tube. Curve 504 is the measured profile of a conventional straight 1 watt nominally rated tube from EG&G Heimann Opto Electronics, 221 Commerce Drive, Montgomeryville, Pa. 18936. Note that except for the region of the curve which is closer than 13 degrees to the axial direction of the tube (x axis angles greater than 77 degrees in FIG. 6) the actual light output from the tube substantially exceeds that predicted by a cosine emission characteristic. This stands to reason since in the flash tube, light is emitted equally in all directions from a gas and not from a line surface source such as from the coating on a fluorescent tube or a linear tungsten filament. Line 505 represents the uniform distribution of the light output in the radial direction and a comparison of this with the very different curve 501 and with the distribution of FIG. 4B which is achieved with the reflector of this invention is good evidence of the effectiveness of the teaching of this invention.

FIGS. 1, 3A, 3B, and 3C depict one of the two similar ends of the transparent cover 18 designed to cover the flash tube and reflector combination. The cover 18 is preferably made of a transparent polycarbonate material and has lenses incorporated in each of the two ends with a preferred version having no lenses in the remaining area 106. The lens 101 is designed to project light in the axial direction of the tube, while the lens 102 is designed to project light 5 degrees forward of the axial direction into the horizontal plane, and the section 103 is designed to project light 10 degrees forward of the axial direction into the horizontal plane. The design is in accord with that detailed in FIG. 5 and the associated description. Sections 104, 105 and 107 are prism shaped with the outside surface forming, for example, an 8.5 degree wedge angle with the inner surface to refract the light which passes through them about 5 degrees back toward the axial direction of the tube. This has the effect of taking light reflected in a direction forward 20 degrees from the axial direction of the tube and re-directing it to a direction 15 degrees forward from the axial direction of the tube where it is needed.

The lens section 101 projects light in the axial direction very effectively and the sections 102 and 103 although still highly effective project successively less sharply focused beams as the direction in which the beam is projected deviates to successively greater degrees from the axial direction of the tube. An experimental lens was tried to project light into the horizontal plane 15 degrees forward of the axial direction of the tube and the relatively poor focus led to the use of the prism which could conveniently refract the reflected light by five degrees taking some light from portions of the horizontal distribution where more than enough was available and shifting the distribution outward toward the axial direction where it was needed. Refracted angles of much more than 5 degrees for the prism would have tended to shift so much light that deficiencies would have been created. Thus the balance of using the generally spherical Fresnel lens sections to project light emanating directly from the tube into directions close to the axial direction of the tube in combination with the prism or cylindrical lens section to shift the reflected light profile toward the axial direction of the tube served to balance the distribution to efficiently meet the required distribution.

Figure 5:
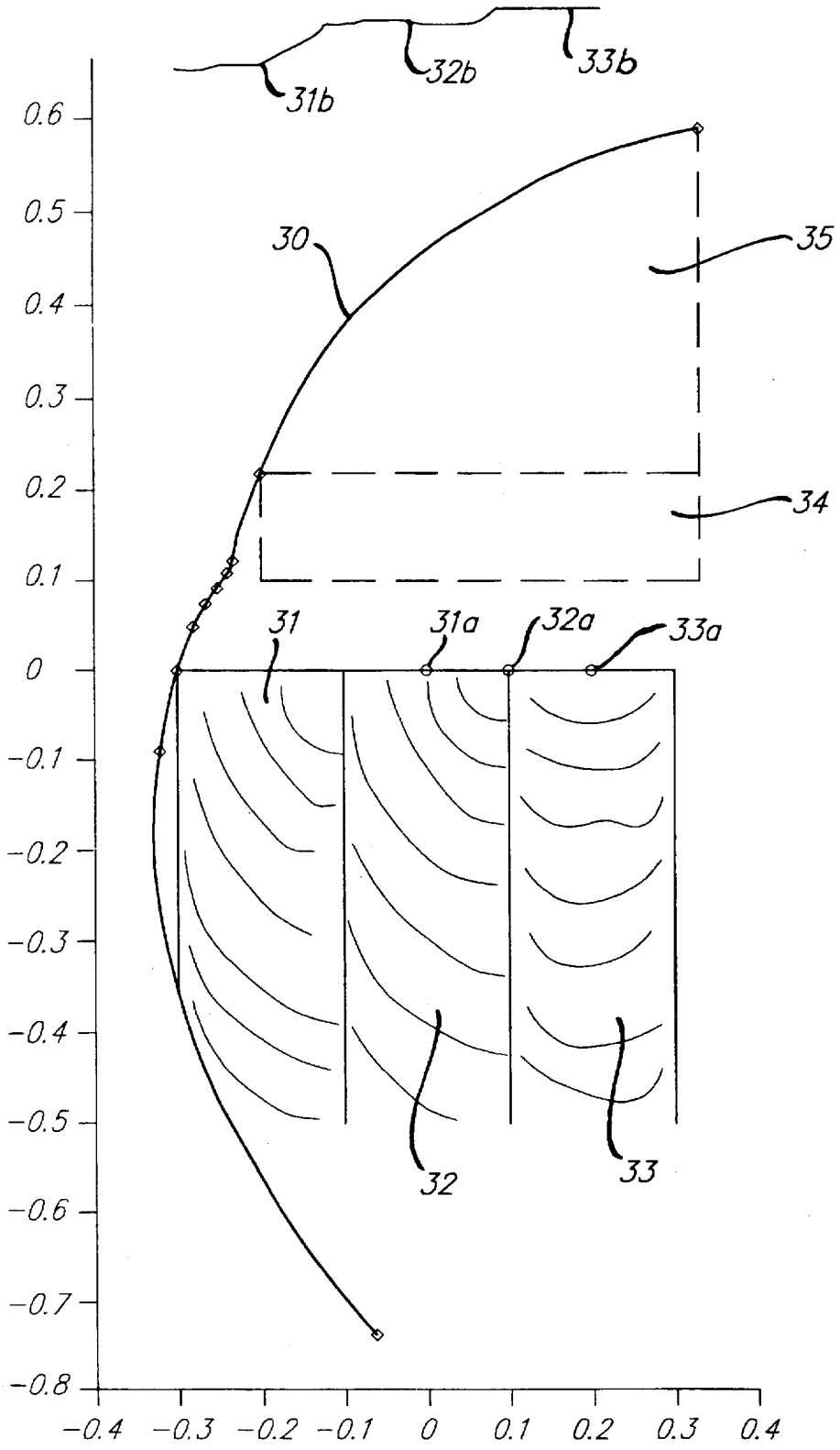
FIG. 5 illustrates portions of the cover at the end of the cylindrical reflector as shown in profile.
Figure 5:
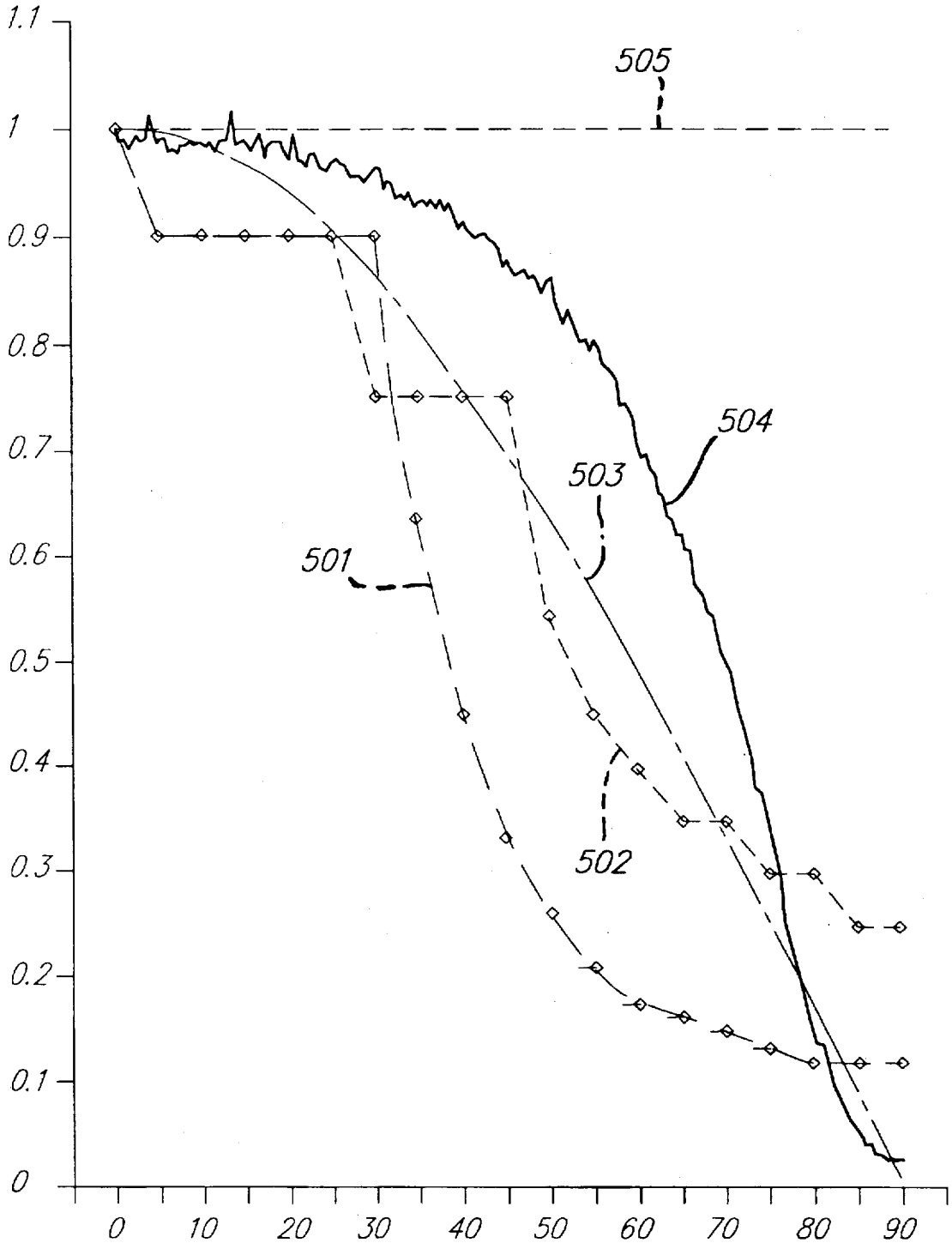

Refer to FIG. 5 which indicates portions of the lens 18 at the end of the cylindrical reflector shown in profile as line 30. The Fresnel lens patch 31 has optical center 31*a* aligned with the axis of the tube and projects its strongest beam in the axial direction of the tube. The Fresnel lens patch 32 has optical center 32*a* and projects its strongest beam in the horizontal plane and outward five degrees from the flash tube axis. The Fresnel lens patch 33 has optical center 33*a* and projects its strongest beam in the horizontal plane and outward ten degrees from the flash tube axis. Optional cylindrical lens portions shown in partial top view as 31*b*, 32*b*, and 33*b* are placed on the opposing side of the lens, the three sections intercepting substantially the same light rays as patches 31, 32, and 33, respectively. Each refracts the light zero degrees at its left end and by progressively greater amounts increasing to a 5 degree refraction at its right end. The effect is to fan the beams, respectively, from zero to 5 degrees, 5 to 10 degrees, and 10 to 15 degrees. The result of the composite is smooth coverage from zero to 15 degrees. The Cylindrical lens cross sections 31*b*, 32*b*, and 33*b* may be circular or they may be a more complex curve designed to characterize the light output pattern within their sweep range. The cylindrical lens portions do not require a slide in the mold to include them.

Area 34 bounded by the reflector and a dotted outline is the portion of the lens at the end through which the light is reflected into the horizontal plane. It is not covered by a lens at least not by one serving a conflicting purpose such as patches 31 through 33. Note that the design in FIG. 3C used prism sections 104, 105 and 107 in this area to re-direct the reflected light passing through this portion of the cover. The lens patches 31 through 33 are designed primarily to focus light which emanates directly from the tube. They intercept and scatter to some degree, the light reflected to the side into the range generally between the horizontal plane and 30 degrees downward toward the floor. The area 35 bounded by the reflector and dotted outline receives light from a second area of the reflector which reflects light into this same range between the horizontal plane and 30 degrees downward toward the floor. This area is preferably left free of lenses which serve a conflicting purpose. Thus one of the two optical paths with overlapping targets is left clear or contains lenses to enhance the pattern of the reflected light so that the net result is not to create strong shadows in the region into which this light is reflected.

Figure 7:
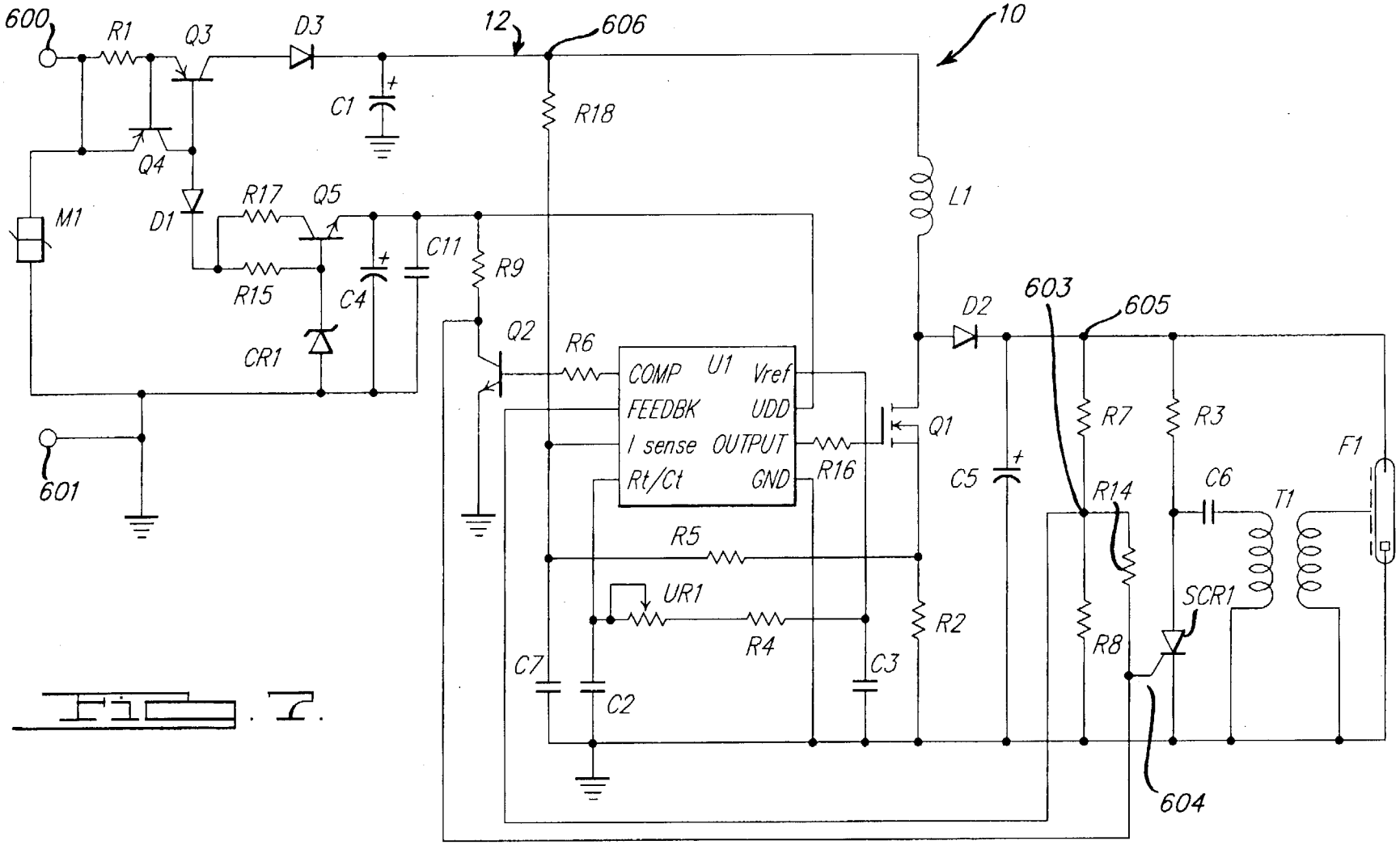
FIG. 7 is a schematic electrical circuit diagram of an alarm system embodying the present invention.

Referring to the circuit diagram of FIG. 7, the circuit is rated to operate between 20 and 30 volts direct current or full wave rectified alternating current (abbreviated DC and FWRAC). UL requires operation between 17 and 33 volts for this rating. The circuitry preferably has limited surge current when first energized and preferably flashes when power is interrupted to support an external synchronizing feature. Such a construction reduces the risk of shock for one who is working with the circuit because an energy storage capacitor incorporated in the circuit is automatically discharged to a much lower voltage by the flash when power is removed.

At the present time, regulations require a minimum flash rate of one flash per second. The current required to run each unit increases in approximate proportion to the flash rate so in order to simultaneously establish a low current consumption and the required flash rate it is important to maintain a consistent flash rate of slightly over one flash per second over the specified operating range of devices embodying the present invention. Uncompensated, the strobe flash rate increases significantly as the supply voltage ranges from its lowest to its highest specified operating levels. A circuit embodying the present invention reduces the peak energy storage capacitor charging current modestly as the operating voltage is increased and the proper selection of resistance values provides for a flash rate which remains nearly constant over the entire specified operating voltage range.

While it may be desirable to use an alternate UC3843B integrated circuit in some applications, in an embodiment of the invention wherein the circuit in which the flash is initiated by an output from the IC the following problem was encountered when using the UC3843B: If the strobe failed to trigger in response to the high voltage trigger pulse, the trigger was reinitiated too quickly for the trigger energy storage capacitor to recover with the result that the unit would not flash again until power was removed and reapplied. This was deemed to provide an inadequate margin of safety and a positive feedback circuit of very limited range was added so that a relatively short but adequate recovery time was added so that the trigger was initiated a number of times per second and whenever the flash responded to a succeeding trigger input after the one to which it did not respond, it did flash successfully. The mechanism for this feature is detailed in the circuit description. The circuit provides for safe, direct initiation of the flash by the pulse width modulator IC without special selection of the IC and without resorting to a separate flash trigger initiating device.

A thermistor has been used in many prior art units to limit inrush current. In these prior art devices, a thermistor whose resistance decreases dramatically as it heats is placed in series with the strobe circuit. When power is first applied to the flash circuit, the thermistor is cold and its resistance high so it effectively limits the inrush current. The self heating of the thermistor then reduces the resistance of the thermistor to the point that normal operation of the flash begins. There are two problems encountered with such a construction. First, the primary problem is that continued operation of the flash requires continued heating of the thermistor which requires roughly nine percent of the total energy for an efficient 110 candela flash and significantly higher fractions of the total energy for flashes with lower candela ratings. The second problem is that the inrush for a momentary interruption where the power is reapplied before the thermistor cools is not adequately limited. To overcome these problems an active current limiting circuit with several special features is employed in circuits embodying the present invention. First, the improved current limiting circuit maintains separate paths to an energy storage capacitor and to a pulse width modulated flyback control circuit. The paths are separated by back to back diodes so that when the supply is interrupted, a current consumed in one of the paths does not draw current from the energy storage capacitor of the alternate path. Also, the circuit is arranged so that the same pair of diodes which operate in the back to back mode above protect the active current limiting circuit as well as the remainder of the circuit when a reversed voltage is applied to the input terminals as for example by connecting the unit up backwards. Second, the supply current for the flyback control circuit provides the base drive for a current limiting pass transistor which conducts to provide the supply current to the energy storage capacitor charging path and operates in a partially conducting mode to limit the inrush current. This is superior to options in which the circuit current is increased by several percent to provide adequate base drive or where a series voltage drop is added to the charging circuit supply to provide the base drive for the current limiting pass transistor. Either approach would have been likely to increase the current consumption requirement by several percent largely offsetting the gain from eliminating the thermistor. As an additional feature, the series resistor and zener diode clamp to regulate the voltage to the flyback control circuit of a prior art circuit is replaced with a circuit which includes an active supply regulator. This circuit greatly reduces the current consumption when the supply voltage is above its minimum operating point and provides for faster filter capacitor charging during the peak portions of the waveform in the (FWRAC) modes of operation. Without this enhancement, it would be difficult to achieve proper operation of the circuit in the FWRAC mode at the lower extreme of the operating voltage range.

Referring to FIG. 7, circuitry embodying the present invention is illustrated therein, the various components thereof being electrically connected by suitable conductors as illustrated. With reference to FIG. 7, a positive voltage of 17 to 33 volts DC or FWRAC is applied to the terminal 600 and a ground return path to terminal 601. Current flows through the current sensing resistor R1 and the current limiting pass transistor Q3 and the rectifier diode D3 to charge the supply voltage filter capacitor C1 and to supply current to the flyback inductor L1 to ultimately charge the energy storage capacitor C5. When the inrush current reaches a threshold value, the voltage drop across R1 turns on the transistor Q4 which limits current to the base of Q3 partially turning it off and limiting the charging current flowing into the circuit from the collector of Q3. R17 and R15 limit the charging current which flows either from the collector of Q4 or the base of Q3 through the rectifier diode D1 and into the supply circuit for the pulse width modulated flyback control circuit. The 12 volt zener diode CR1 clamps voltage due to current supplied through R15 to approximately 12 volts. The voltage follower transistor Q5 receives its base current from the 12 volt source and its collector current through the current limiting resistor R17 and supplies approximately 11.4 volts to the flyback control circuit. The capacitor C4 filters this supply and its value in part determines the time that it takes to discharge to the nominal 7.6 volt turn off threshold of the IC U1 at which point the flash is triggered. Note that this is the normal mode for triggering only in a synchronized mode. Otherwise the flash is triggered when the threshold maximum voltage is reached on the energy storage capacitor C5. The control circuit supply current and the capacitance of C4 determines the length of time for C4 to discharge from its nominal 11.4 volt operating voltage to the nominal 7.6 volt turn off threshold and to trigger the flash when power is interrupted. The value of C4 is normally chosen so that this time period is about 10 milliseconds. It must be longer than the nominal 4 millisecond interval between charging pulses of the full wave AC and it must be shorter than the momentary supply voltage interruption that is used in some applications to trigger the flash. The value of C4 may be adjusted to meet these requirements and must be increased substantially when the bipolar, higher supply current, UC3843B IC is used for U1 instead of the MIC38C43. The UC3843B and detailed data sheets which detail its operation are available from Motorola of Phoenix, Ariz. and the MIC38C43 and detailed data sheets are available from Micrel Inc. of San Jose, Calif. C11 is used in parallel with C4 to filter higher frequency components in the supply voltage. The output VREF is switched to 5 volts and the COMP output is enabled when the supply VCC reaches the start threshold which is nominally 8.4 volts and VREF is turned off and the COMP output disabled when VCC falls below the minimum operating voltage threshold which is nominally 7.6 volts. VREF is filtered by C3 and supplies current through the series pot VR1 and the resistor R4 to charge the timing capacitor C2. When the voltage on C2 reaches an upper threshold, the output pulse on the OUTPUT pin of U1 is initiated and C2 is momentarily shorted by U1 to rapidly discharge it. The charge discharge sequence is repeated to create a highly uniform repetition rate and resulting frequency for initiation of the pulse to charge the inductor L1. The circuit components including the value of inductor L1 may be chosen for operating frequencies which may for example lie in the 10 to 50 hertz range but which are not limited to this range. Pot VR1 is adjusted to trim the operating flash rate to achieve just over one flash per second. A decrease in the capacitance of C2 or in the resistance of R4 also increase the flash rate. In general these components are adjusted so that the current in L1 decays to zero for most of the charging cycles. This is referred to as the non continuous mode since a nonzero current is not maintained in L1. U1 does operate satisfactorily in either the continuous or the non continuous modes, but flash rate performance is most stable in the non continuous mode. R16 is a resistor of low value to slightly limit turn on or turn off rise and fall times for Q1. In general these times should be fast but judicious limits may reduce radiated noise or problem circuit voltage waveform ringing. When the OUTPUT pin of U1 is switched high, Q1 is turned on and current from the supply rises in L1 until the voltage drop across R2 rises to the point that the voltage at ISENSE rises to a nominal threshold level of one volt at which point the OUTPUT pin of U1 is switched low turning off Q1. The current in L1 continues to flow because of the inductance of L1 and flows through D2 to add charge to energy storage capacitor C5. As the voltage on C5 builds, the charging pulses become short as the current in L1 decays rapidly. When the voltage C5 increases to about 240 volts, the voltage at node 603 between resistors R7 and R8 and R14 increases to a nominal switching threshold value of about 2.5 volts at the FEEDBK pin of U1. At this point, the comp output is switched low turning off transistor Q2 which allows current from R9 to trigger SCR1 which discharges C6 into the trigger coil T1. The nominal 10 kilovolt ringing output from T1 is applied to the trigger lead which is wrapped around the flash tube F1 causing it to conduct and to substantially discharge the energy stored on C5. The desired bright flash of light is emitted by this process. The charging process begins again and C6 is charged through R3. After a little less than one second, the charge on C5 builds to 240 volts at which point the next flash is triggered.

In the event that the flash tube does not trigger in response to the triggering sequence above, then F1 does not conduct to discharge C5 and its voltage may remain at or near the threshold level. The turn off of Q2 which initiated the trigger process raises the voltage at the gate 604 of SCR1 by about 0.5 volts. This 0.5 volt rise at node 64 increases the node voltage at 605 by about the same amount as a 5 volt rise on the energy storage capacitor C5 at node 605 because the value of R7 is 10 times that of R14. The effect of the increased voltage at node 603 which goes to the FEEDBACK pin of U1 is to make it look to U1 like the energy storage capacitor is overcharged. U1 supplies minimal charge to energy storage capacitor until its voltage is reduced by about 5 volts due in part to the discharge path through R7, R8, and R14 and R3 and SCR1. At this point, Q2 is turned on turning off SCR1 and increasing the voltage to which C5 must charged by about 5 volts due to the half volt decrease in the voltage at the gate of SCR1 and its coupling through R14. During the brief interval while C5 is recharging, there is ample time for the energy storage capacitor C6 in the trigger circuit to charge through R3. When, the voltage reaches the trigger threshold a trigger pulse is reinitiated. This process repeats a number of times per second until the tube triggers. Other values may be chosen for R14 and the effect of the limited positive feedback range may be designed for other than a 5 volt hysteresis. The important effect is that in the event that the flash tube does not respond to its trigger input, to provide a positive feedback path from the trigger circuit to result in a discharge and recharge of the energy storage capacitor within a limited range in order to provide adequate recovery time for the trigger circuit to periodically re-trigger the flash tube. The voltage to which C5 is charged is determined by the divider ratio between R7 and the parallel combination of R8 and R14 and by the threshold of U1 at its FEEDBACK pin.

R5 and C7 provide high frequency filtering in the current sensing path of the control circuit. R18 is added so that the divider formed primarily by R18 in series with R5 creates a voltage drop across R5 which elevates the voltage at ISENSE by an amount which is proportional to the supply voltage to the flyback charging circuit at node 606. The degree to which the voltage at ISENSE is elevated for a particular voltage at node 606 is determined primarily by the ratio of R18 to R5. The voltage at ISENSE is the sum of the voltages across the flyback inductor current sensing resistor R2 and the resistor R5. As the voltage across R5 increases the current and resulting voltage at R2 required to reach the current turn off threshold at ISENSE is reduced. Thus, a given increase in the voltage at node 606 results in a decrease in the current sensing threshold voltage and the resulting peak charging current by an amount determined by the ratio of R18 to R5. The proper choice of this ratio substantially stabilizes the circuit so that the flash rate remains very stable over the specified supply voltage range of the circuit. The initial charging current to C5 is directly related to and when other losses are low is substantially equal to the peak charging current in L1 as sensed by the voltage on R2. Thus the voltage at node 606 alters the peak charging current to C5.

The metal oxide varistor M1 absorbs over voltage transients protecting the remainder of the circuit from them.

The values of the current sensing resistor R2 and of the frequency timing elements C2 and R4 are adjusted to provide a desirable operating frequency of the oscillator and a nominally correct flash rate. VR1 is then adjusted to make a final trimming adjustment in the flash rate.

The following is an identification of various components of the circuitry described above, it being understood that these specified components may be varied depending upon the particular applications of the principles of the present invention.

| | |
|---|---|
| U1 | Micrel, MIC38C43BN |
| VR1 | Pot., .1 W 5K |
| Q1 | Transistor, IRF720 HEXFET |
| Q2 | Transistor, 2N3904 |
| Q3 | Transistor, MPSA56 |
| Q4 | Transistor, 2N3906 |
| Q5 | Transistor, MPSA06 |
| C1 | Cap, A.E. 100 MFD 35 V LL |
| C2 | Cap, Axial 0.0068 uF |
| C3 | Cap, Axial 0.1 UF |
| C4 | Cap, A.E. 22 MFD 35 V |
| C5 | Cap, A.E. 68 MFD 250 V |
| C6 | Cap, (Metal) POLY 0.047 uF 400 V |
| C7 | Cap, Ceramic Disc 100 pF, 500 V |
| | Connector, Header 6 PIN MINI JST |
| C11 | Cap, 0.1 uF |
| T1 | Coil, Trigger ZS1052 |
| L1 | Coil, 1 mH (Radial) |
| SCR1 | Scr, MCR22-6 |
| F1 | Flash Tube, BGA 1020 |
| R1 | Res., ¼ W 1.8 OHM |
| R2 | Res., 1.8 OHM |
| R3 | Res., ¼ W 100K |
| R4 | Res., ¼ W 10K |
| R5 | Res., ¼ W 2.2K |
| R6 | Res., ¼ W 39K |
| R7 | Res., ¼ W 1M 1% |
| R8 | Res., ¼ W 11.3K |
| R9 | Res., ¼ W 33K |
| R14 | Res., 100K |
| R15 | Res., ¼ W 8.2K |
| R16 | Res., ¼ W 10 OHM |
| R17 | Res., ¼ W 470 OHM |
| R18 | Res., ¼ W 470K |
| D1 | Diode, 1N4148 |
| D2 | Diode, Fast Recov. 1N4936 |
| D3 | Diode, 1N4004 |
| CR1 | Diode, Zener 1N5242 |
| M1 | Metal Oxide Varistor |

If desired, a conventional pizzo horn may be incorporated in each strobe unit, the pizzo horn circuitry being based on well known metal gate CMOS integrated circuitry, the operation of which is known in the art and need not be described in detail.

While preferred embodiments of the invention have been illustrated and described, it will be understood that various changes and modifications may be made without departing from the spirit of the invention.

What is claimed is:

1. An alarm system comprising, in combination, a signaling unit, said signaling unit including an elongate flash tube capable of emitting flashes of light and having a longitudinal axis, light reflector means adapted to reflect light emitted by said flash tube, Fresnel lens means effective to focus and direct flashes of light emitted by said flash tube, said reflector means cooperating with said Fresnel lens means to direct light emitted by said flash tube in a predetermined pattern, and an electrical circuit means for energizing said flash tube at a predetermined rate, said flash tube having a light emitting portion intermediate the ends thereof, said reflector means having reflective surfaces thereon longer than said light emitting portion of said flash tube, said unit including a transparent cover having sections defining said Fresnel lens means positioned close to the longitudinal axis of said flash tube whereby at least some of said Fresnel lens means directs light into beams to cover predetermined areas close to the axis of said flash tube.

2. The combination as set forth in claim 1, said transparent cover having a centrally disposed clear area, said Fresnel lens means being disposed on opposite sides of said clear area.

3. The combination as set forth in claim 1, said cover defining cylindrical lens sections on opposing faces of said cover relative to said Fresnel lens means and optically aligned with portions of said Fresnel lens means so as to fan bright spots of light emanating from said flash tube into elongated patches covering several degrees of light emitting angle for each of the Fresnel lens portions which are so arranged.

4. The combination as set forth in claim 1, said cover defining spherical lens sections adapted to focus light generally in the direction of said longitudinal axis of said flash tube.

5. An alarm system comprising, in combination, a signaling unit, said signaling unit including an elongate flash tube capable of emitting flashes of light and having a longitudinal axis, light reflector means adapted to reflect light emitted by said flash tube, Fresnel lens means effective to focus and direct flashes of light emitted by said flash tube, said reflector means cooperating with said Fresnel lens means to direct light emitted by said flash tube in a predetermined pattern, and an electrical circuit means for energizing said flash tube at a predetermined rate, said light reflector means including a cylindrical reflective surface defining a discontinuity in the slope of the cylindrical reflective surface at a level above the top of said flash tube whereby the portion of said reflective surface disposed below said discontinuity and generally back of said flash tube reflects light generally downwardly at angles of declination great enough to prevent substantially all of the reflected light from striking said flash tube.

6. The combination as set forth in claim 5, said reflector means having a generally parabolic shaped section adjoining said discontinuity and effective to reflect light into a horizontal plane.

7. An alarm system comprising, in combination, a signaling unit, said signaling unit including an elongate flash tube capable of emitting flashes of light and having a longitudinal axis, light reflector means adapted to reflect light emitted by said flash tube, Fresnel lens means effective to focus and direct flashes of light emitted by said flash tube, said reflector means cooperating with said Fresnel lens means to direct light emitted by said flash tube in a predetermined pattern, and an electrical circuit means for energizing said flash tube at a predetermined rate, said Fresnel lens means including relatively small diameter angular portions adapted to focus at a point between the center and the adjacent end of the light emitting portions of said flash tube.

8. The combination as set forth in claim 7, said Fresnel lens means including relatively large diameter angular portions focusing between the center and the remote end of said flash tube.

9. An alarm system comprising, in combination, a signaling unit, said signaling unit including an elongate flash tube capable of emitting flashes of light and having a longitudinal axis, light reflector means adapted to reflect light emitted by said flash tube, Fresnel lens means effective to focus and direct flashes of light emitted by said flash tube, said reflector means cooperating with said Fresnel lens means to direct light emitted by said flash tube in a predetermined pattern, and an electrical circuit means for energizing said flash tube at a predetermined rate, said light reflector means including a cylindrical reflective surface having an axis parallel to said axis of said flash tube, said reflective surface extending to cover substantially the entire area back of the light emitting portions of said flash tube, said cylindrical reflective surface being at least as long as the light emitting portions of said flash tube and being positioned parallel to and directly back of said light emitting portions of said flash tube.

10. The combination as set forth in claim 9, said reflective surface extending between planes which are perpendicular to the axis of said flash tube and which intersect said flash tube at each end of its light emitting portion.

11. An alarm system comprising, in combination, a signaling unit, said signaling unit including an elongate flash tube capable of emitting flashes of light and having a longitudinal axis, light reflector means adapted to reflect light emitted by said flash tube, Fresnel lens means effective to focus and direct flashes of light emitted by said flash tube, said reflector means cooperating with said Fresnel lens means to direct light emitted by said flash tube in a predetermined pattern, and an electrical circuit means for energizing said flash tube at a predetermined rate, said means for energizing said flash tube including feedback circuit means effective to trigger said flash tube, said circuit including a pulse width modulator integrated circuit.

12. The combination as set forth in claim 11, said circuit including an energy storage capacitor and a pulse width modulated flyback control circuit, and means maintaining separate electrical paths to said storage capacitor and to said flyback control circuit.

13. The combination as set forth in claim 12, said circuit including a current limiting transistor adapted to conduct to provide a supply current to said energy storage capacitor.

14. A visual signaling system adapted to be connected to a source of electrical power, said system comprising, in combination, a flash tube capable of emitting flashes of light, capacitor means for storing electrical energy from the power source, means for applying power from said capacitor means to said flash tube to cause said flash tube to emit flashes of light, means for triggering said means for applying power from said capacitor means, and light reflector means adapted to reflect light emitted by said flash tube whereby substantially all of the reflected light is prevented from striking said flash tube, said light reflector means including cylindrical light reflective surfaces defining a discontinuity.

* * * * *